United States Patent [19]

Redman

[11] 4,162,732

[45] Jul. 31, 1979

[54] COIL TRANSFER MACHINE

[75] Inventor: Howard E. Redman, Duxbury, Mass.

[73] Assignee: Mathewson Corporation, Quincy, Mass.

[21] Appl. No.: 795,329

[22] Filed: May 9, 1977

[51] Int. Cl.[2] ..... B21F 45/00; B66C 1/42

[52] U.S. Cl. ..... 414/736; 140/3 CA; 198/403; 198/458

[58] Field of Search ..... 214/1 BB, 1 BD, 1 Q, 214/6 A; 198/379, 403, 458; 140/3 CA

[56] References Cited

U.S. PATENT DOCUMENTS

| | | | |
|---|---|---|---|
| 3,410,417 | 11/1968 | Fouse | 214/1 BD |
| 3,441,064 | 4/1969 | Fischer et al. | 140/3 CA |
| 3,480,161 | 11/1969 | Bason | 214/6 A |
| 3,580,442 | 5/1971 | Rohdin et al. | 198/458 X |
| 3,987,889 | 10/1976 | Godoy | 198/456 |
| 3,990,587 | 11/1976 | Redman | 214/8.5 C |

*Primary Examiner*—L. J. Paperner

*Attorney, Agent, or Firm*—Dike, Bronstein, Roberts, Cushman & Pfund

[57] ABSTRACT

Apparatus for receiving a row of spaced coils in which the coils are at a predetermined spacing and transferring them to a coil assembly machine at a different spacing.

2 Claims, 13 Drawing Figures

COIL TRANSFER MACHINE

BACKGROUND OF INVENTION

In the manufacture of innerspring assemblies, coils are delivered in rows with the coils at a predetermined spacing and orientation to an assembly machine where they are laced together. Since the innerspring assemblies vary in size and the spaces between the number of coils in the given lengths are desirably varied to provide for assemblies of different degrees of yield, it is desirable to be able to adjust the spacing of the coils in the rows prior to delivery to the assembly machine. In U.S. Pat. No. 3,990,587, there is provided coil gripping means for taking coils from a plurality of magazines arranged at a predetermined spacing and transferring them to the spring assembly machine at the same spacing. The present invention resides in an improvement of the aforesaid machine which enables taking the coils from the magazines at a predetermined spacing and, while transferring them to the assembly machine, changing the spacing to a predetermined different spacing corresponding to the size of the assembly to be made and/or the spacing to be employed between coils in the assembly.

SUMMARY OF INVENTION

As herein illustrated, the apparatus comprises a plurality of magazines for receiving groups of coils, said magazines being situated at a predetermined spacing, means situated at the discharge ends of the magazines for gripping the coils at said ends and transferring them to an assembly machine, said means being movable relative to each other to change their spacing from a spacing corresponding to the spacing of the magazines to a different spacing and means operable during the transfer to effect relative movement of said means to present the coils to the assembly machine at said different spacing.

A beam mounted for rotation about a horizontal axis supports the coil gripping means for movement from a position facing the magazines to a position facing the spring assembly machine and for relative movement along the beam from a spacing corresponding to that of the magazines to the spacing required for the particular spring assembly being made up. Specifically, the beam contains longitudinally thereof an opening within which the gripping means are slidably mounted for movement relative to each other and there are coupling elements which adjustably connect the gripping means with each other which can be manually adjusted to permit the gripping means to be moved relative to each other a predetermined distance and the means for effecting such relative movement is a reciprocal movable member connected to the gripping means at the one end of the row of stripping means which, when moved in one direction, moves the gripping means toward each other and, in the other direction, away from each other. The aforesaid means may be, for example, a piston rod extending from an air cylinder to which air is supplied to effect reciprocation of the rod in synchronism with the oscillatory rotation of the beam.

The invention will now be described in greater detail with reference to the accompanying drawings, wherein.

Figure 1:
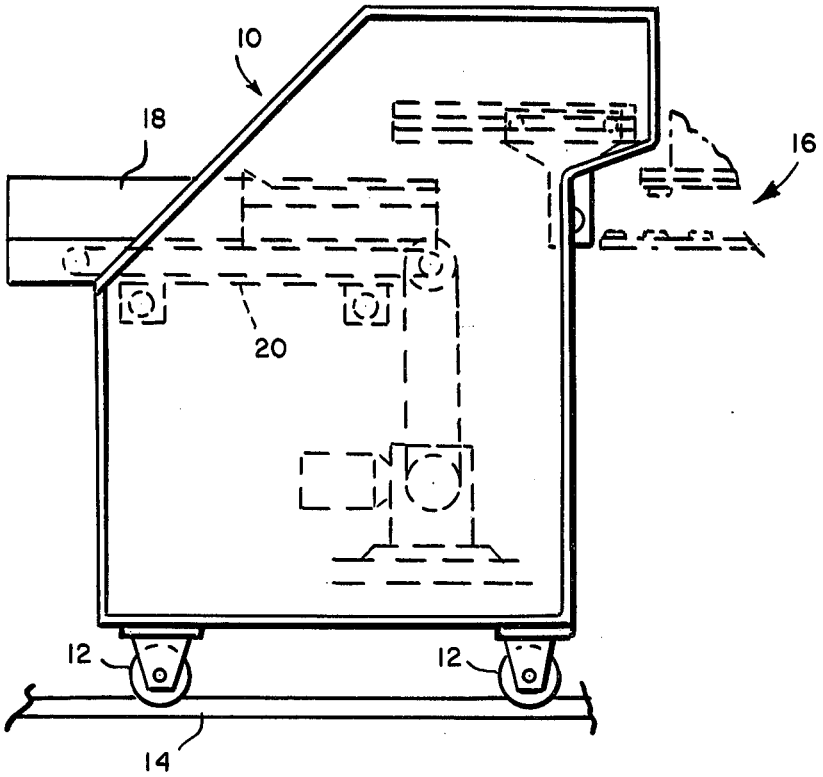
FIG. 1 is a side elevation of the coil separating and transferring the apparatus of this invention.
Figure 2:
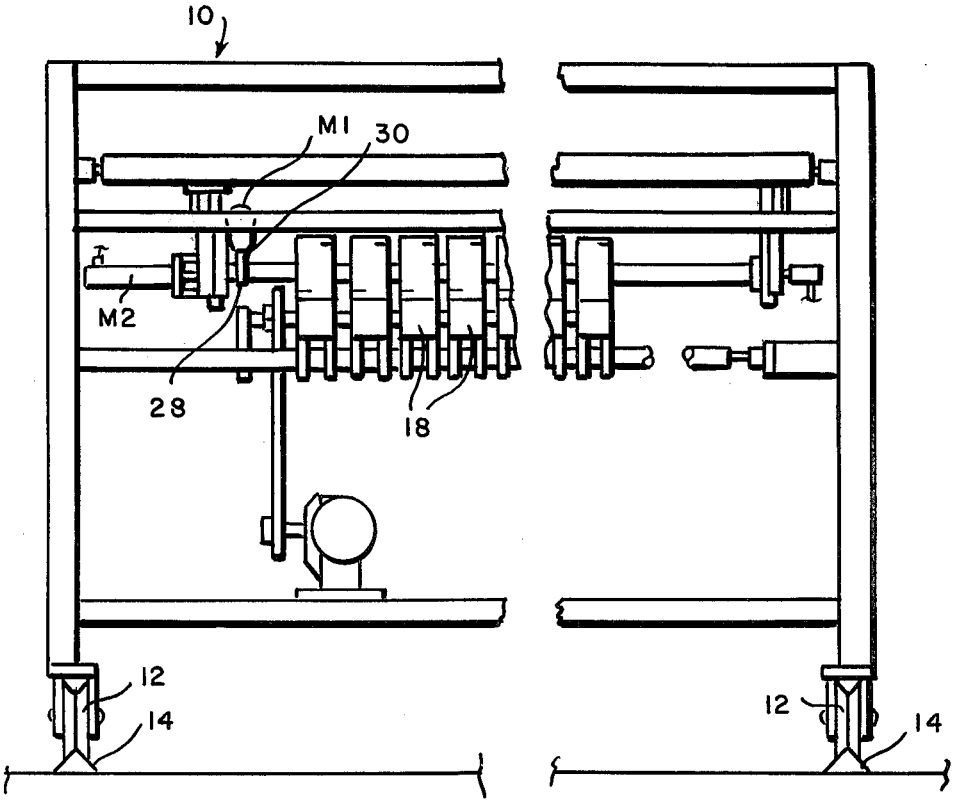
FIG. 2 is a front elevation as seen from the right side of FIG. 1.
Figure 3:
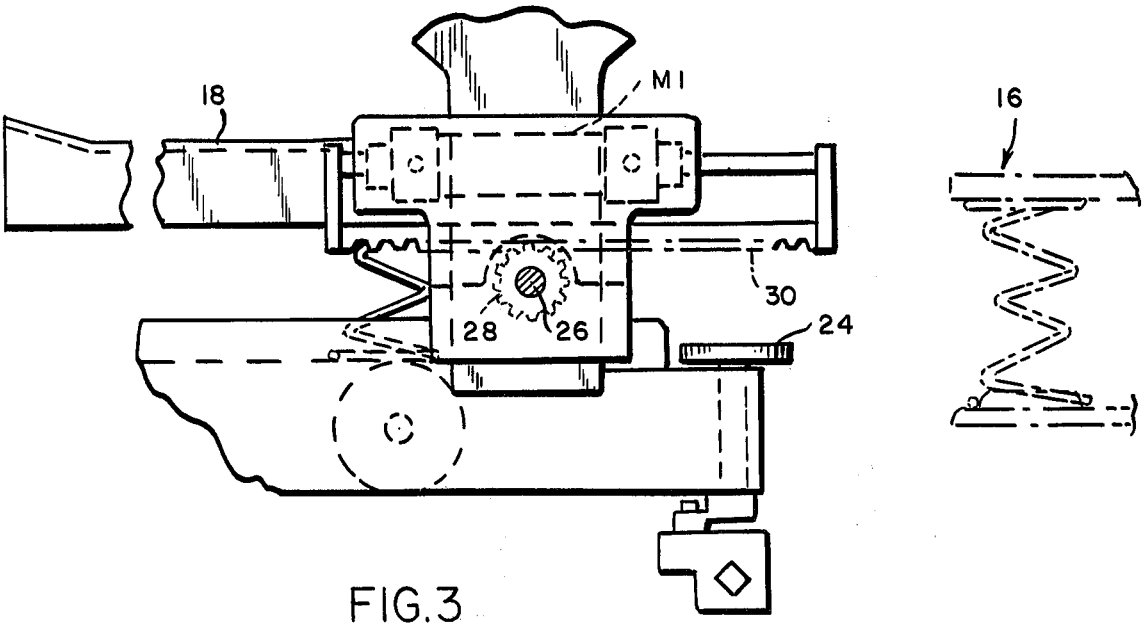
FIG. 3 is a fragmentary side elevation to much larger scale showing the position of the coil-orienting and transferring means in position for receiving a coil.
Figure 4:
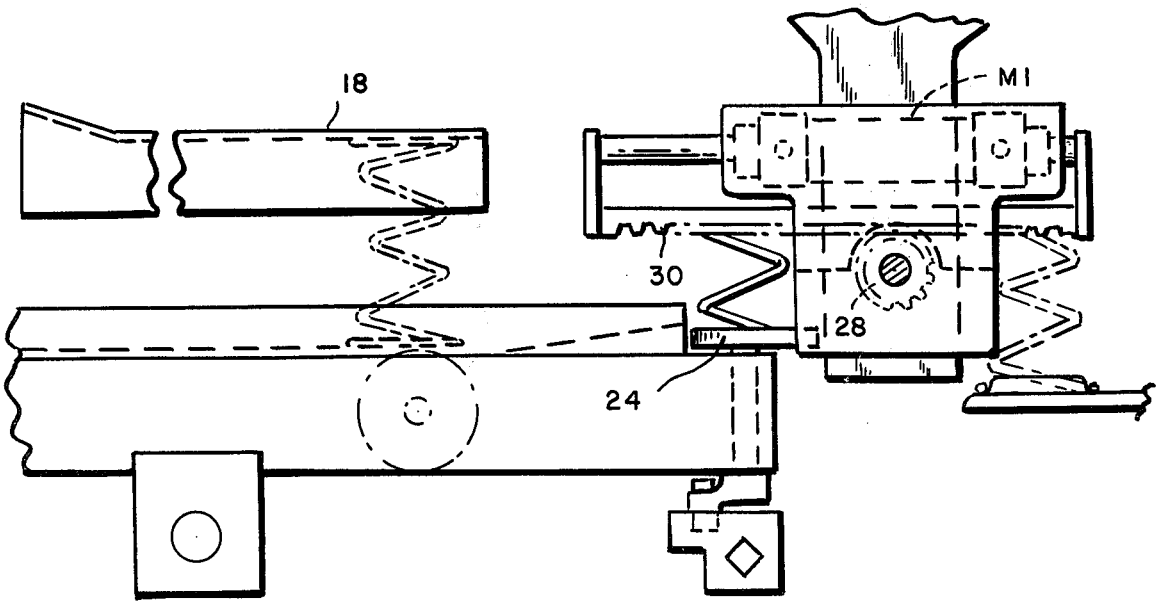
FIG. 4 is a side elevation of the coil-orienting and transferring means following separation of the leading coil in the transfer position.
Figure 5:
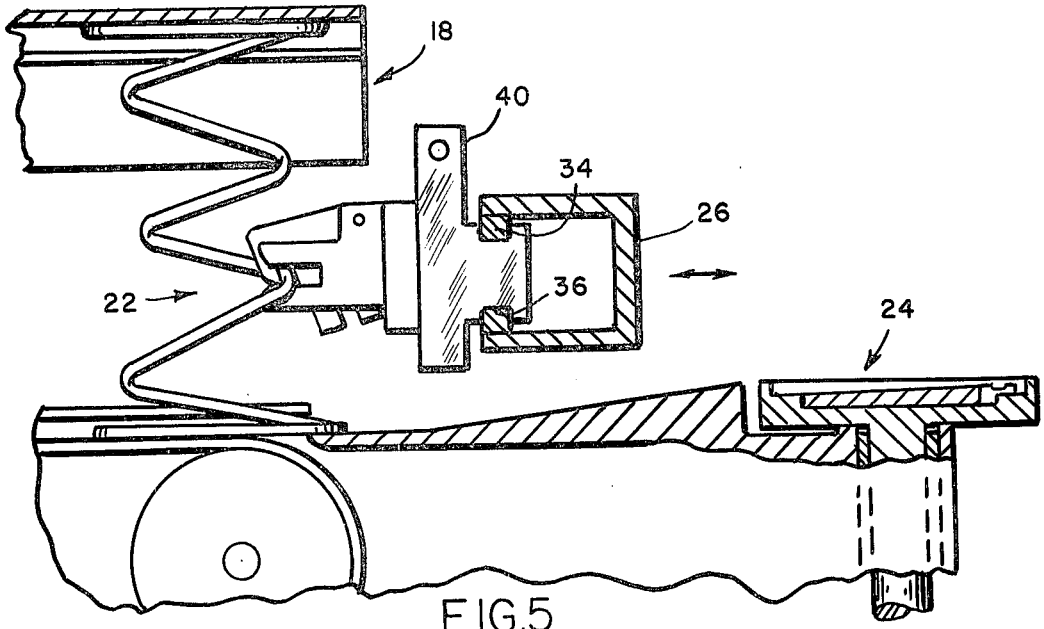
FIG. 5 is a fragmentary elevation to still larger scale showing the gripper assembly engaged with the coil for moving the coil onto the turntable for orientation.
Figure 6:
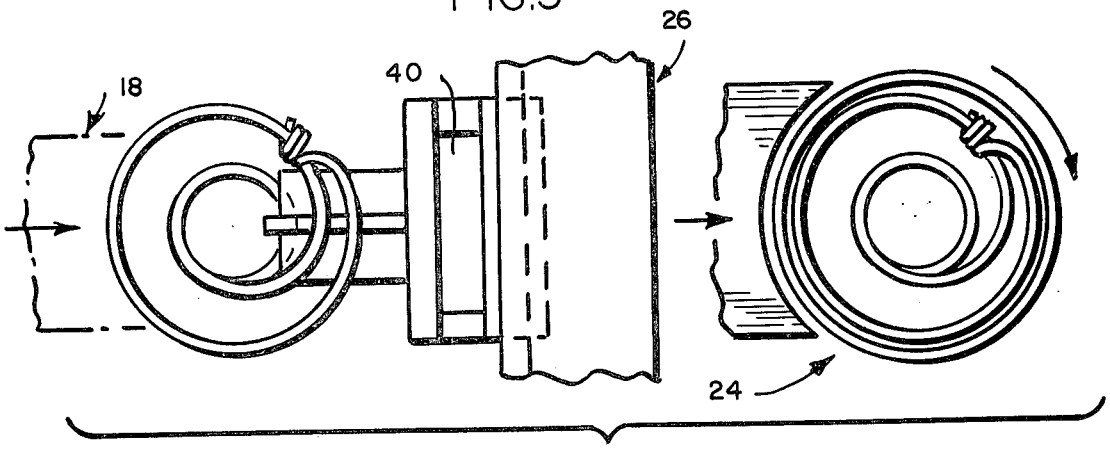
FIG. 6 is a plan view of FIG. 5.
Figure 7:
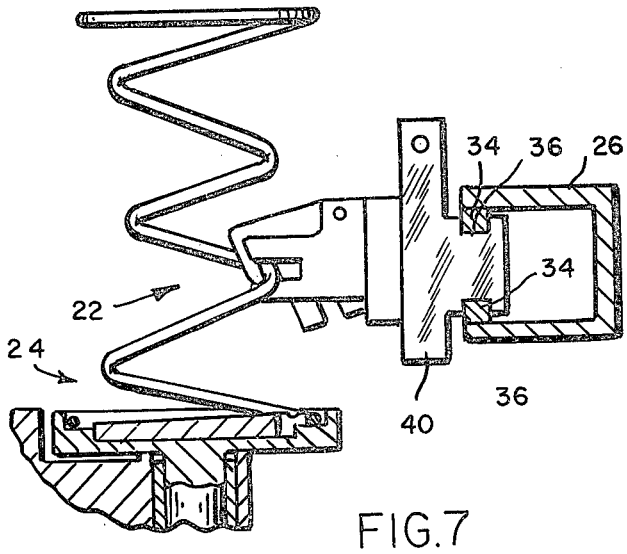
FIG. 7 is a fragmentary elevation showing the coil drawn onto the turntable.
Figure 8:
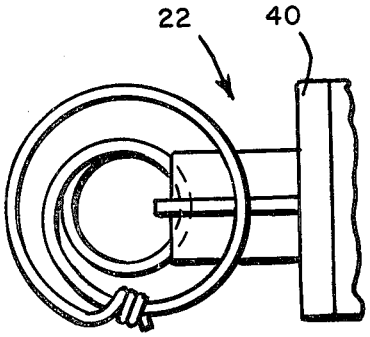
FIG. 8 is a plan view of FIG. 7.
Figure 9:
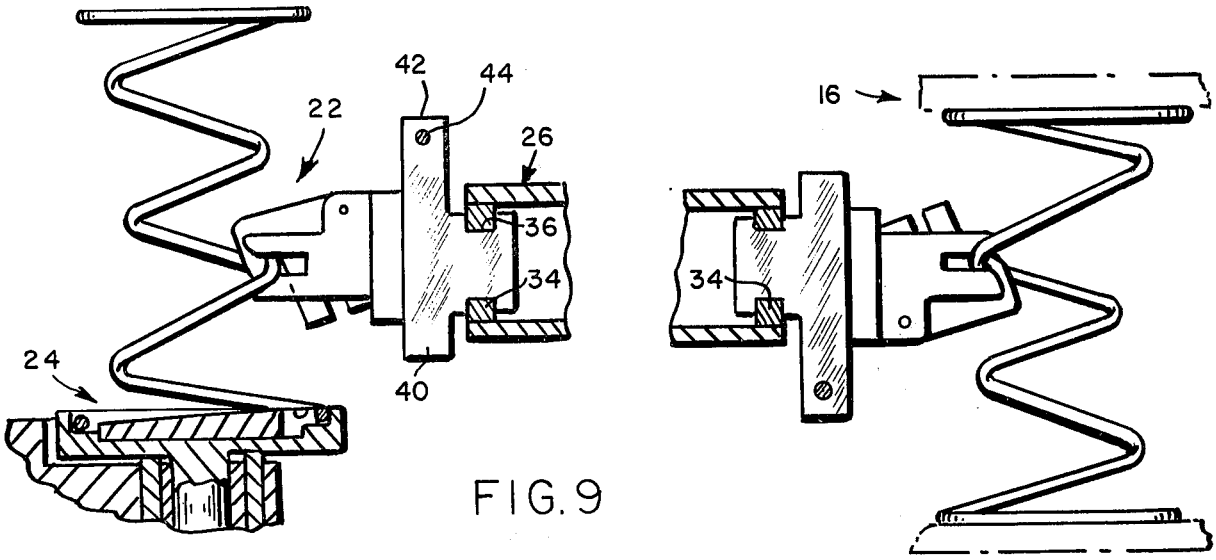
FIG. 9 is a fragmentary elevation showing rotation of the gripper assembly from the turntable to the assembly machine.
Figure 10:
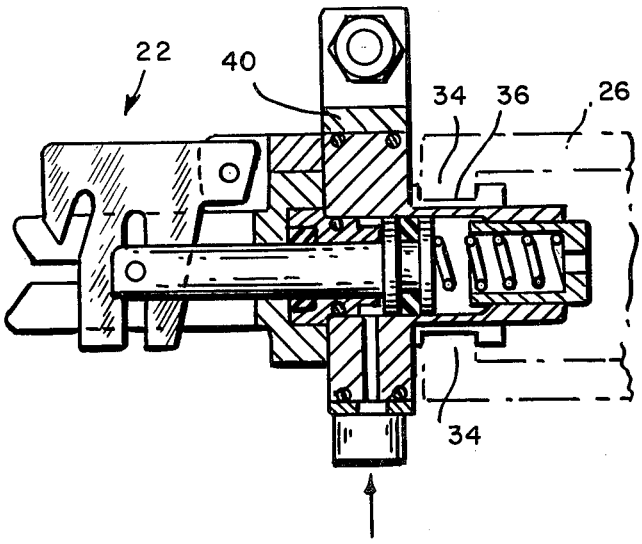
FIG. 10 is a fragmentary elevation partly in section showing the initial position of the gripper assembly before being actuated.

Referring to FIGS. 1 and 2, there is shown coil transfer apparatus 10 mounted on supporting wheels 12 for movement along tracks 14 relative to a coil assembly apparatus 16. The purpose of the apparatus is to receive groups of coils, separate the individual coils from the groups, rotate them so as to dispose the knots at the upper and lower ends of the coils all in the same position, and present a transverse line of spaced coils to the spring assembly machine. For this purpose, the apparatus is provided with horizontally disposed, spaced parallel magazines 18 for receiving batches of coils, each magazine being provided at its bottom with a conveyor 20 by means of which the coils are advanced along the magazine toward coil gripping means 22, FIGS. 5 to 8, the latter being adapted to grip the leading coil intermediate its upper and lower ends and extract it from the succeeding coils, move it onto a turntable 24, FIGS. 3 and 6, for rotating it about its vertical axis to dispose the knots in a predetermined position of orientation, rotate it about a horizontal axis from the position shown at the left-hand side of FIG. 9 to an inverted position as shown at the right-hand side of FIG. 9 and release it to the spring assembly machine 16. FIGS. 4 and 5 show the movement of the coil from the position where it is gripped and separated from the group of coils in the magazine onto the turntable 24 for rotation about its vertical axis and FIG. 9 shows its rotation to the position of release to the spring assembly machine 16.

The coil transfer apparatus as briefly described above is the subject matter of U.S. Pat. No. 3,990,587 to which reference may be made for the details of construction and operation.

In the aforesaid patented apparatus, the coil gripping means 22 are at a fixed, predetermined spacing from each other so that the spacing of the coils in the line of coils presented to the spring assembly machine is always the same. This has the disadvantage that if a spring assembly is to be made which is of a different dimension or a spring assembly is to be made wherein the spacing of the coils is to be different, the magazine must be adjusted to change the spacing which is a major undertaking and results in loss of time. Alternatively, several machines would have to be kept on hand set up for different size spring assemblies and this is costly.

It is the purpose of this invention to so modify the spring transfer means of the aforesaid patent so that a single machine can be used to provide for spring assemblies of different size and/or wherein the springs in an assembly have a different spacing.

Figure 13:
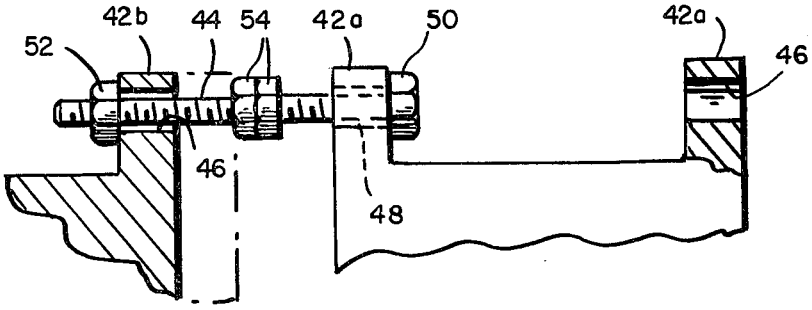
FIG. 13 is an enlarged fragmentary elevation partly in section showing the connection between the coil gripping means.
Figure 11:
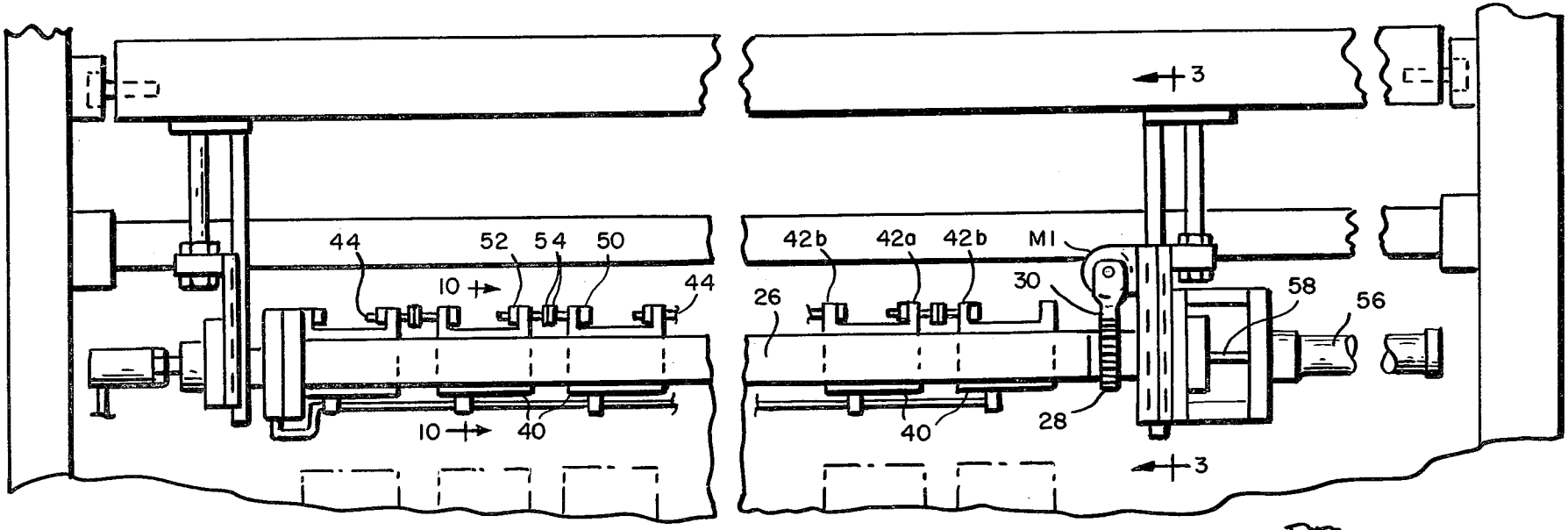
FIG. 11 is an elevation transversely of the transfer apparatus as shown from the right side of FIG. 1 showing the coil gripping means and means for adjusting their spacing prior to rotation of the coil gripping means from the position of receiving the coils to the position of depositing the coils.
Figure 12:
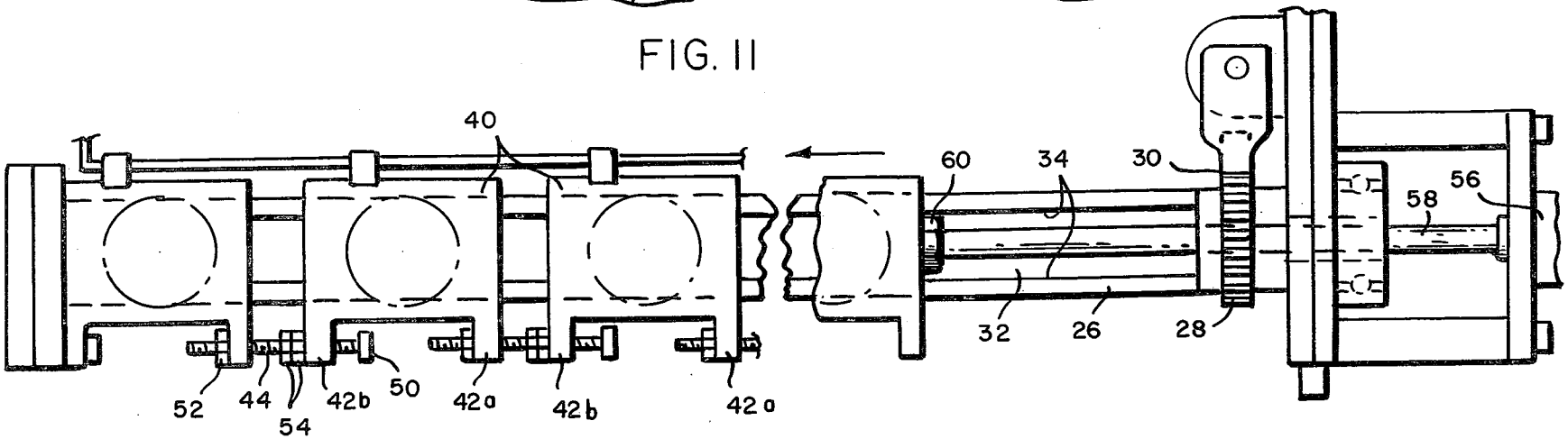
FIG. 12 is a corresponding elevation showing the coil gripping means in the position following rotation from their position of receiving the coils to their position for depositing the coils.

In the aforesaid patented structure, the gripping means 22 were fixedly mounted to a beam 26, FIGS. 5 to 12, mounted transversely of the apparatus for rotation about a horizontal axis, the beam being rotatably supported at its ends by suitable bearings and its rotation being effected by a gear 28, FIGS. 11 and 12, fixed to one end and rack 30 in mesh therewith, the latter being connected to a hydraulic motor M1 for reciprocation. Since this structure is clearly described in the aforesaid patent, it will not be further detailed herein. Rotation of the beam 26 with the grippers 22 fixed thereto from the left-hand position shown in FIG. 9 to the right-hand position also shown in FIG. 9 inverts the coil and, in accordance with this invention, during the period of inversion, the coil gripping means 22 are moved relative to each other along the beam to change the spacing between them so that when the coil gripping means 22 reach the right-hand position, they will have a different spacing from that which they had at the left-hand position, which spacing will be determined by the size of the spring assembly to be made or the spacing of the coils within a given spring assembly. This is achieved by providing the beam 26 as shown in FIG. 12 with an axially extending opening 32 having spaced, parallel shoulders 34—34 and providing the gripping means 22 with grooves 36—36 for slidingly receiving the undercut shoulders 34—34 so that the gripping means 22 can be moved longitudinally along the face of the beam. The gripping means 22 are mounted to substantially rectangular blocks 40 which have at their rear sides the aforesaid grooves 36–36 and these blocks have, along their top side as seen in FIG. 11, spaced, parallel arms **42*a*—42*b* which are connected from block-to-block by screw bolts 44 which are inserted through a smooth bore opening 46 in the arms 42*b* and threaded into a threaded opening 48. The screw bolt 44 has a head 50 at one end engaged with the arm 42*a* and a nut 52 is screwed onto the other end against the arm 42*b*. A pair of nuts 54 screwed onto the bolt between the arms provides for determining the spacing between the blocks and, hence, the grippers. As thus connected together, if the end block of the line of blocks on the beam is moved longitudinally of the beam in one direction, the spacing between the blocks can be closed up, for example, to that shown in dotted lines in FIGS. 12 and 13. By movement of the end block in the opposite direction, the spacing beteen the blocks can be increased by the distance between the nuts 54 and the inner side of the arm 42*b*. By adjusting the position of the nuts 54 on the screw bolt, this distance can be varied as required for the particular spring assembly to be manufactured. Movement of the blocks is provided for by a motor M2 comprising an air cylinder 56 from which protrudes a piston rod 58, the distal end of which is connected by a connector element 60 to the endmost block 40. Air is supplied to the cylinder 56 to effect reciprocation of the piston rod 58** during the rotation of the beam from the position in which the grippers face the magazine to the position in which they face the spring assembly apparatus.

The apparatus operates in the same fashion as that disclosed in U.S. Pat. No. 3,990,587 with the added function that, as the beam 26 is rotated from the position in which the gripping means face the magazines to the position in which they face the spring assembly machine, air is supplied to the cylinder 56 to effect movement of the gripping means longitudinally of the beam to change the spacing from that which corresponded to the spacing of the magazine to the spacing determined by the position of the nuts 54 on the screws 44 which is chosen, of course, to provide for presenting the springs in a spaced relation corresponding to that desired for the spring assembly machine.

It is thus apparent from the foregoing that the machine of the aforesaid patent which formerly was designed to transfer springs at a predetermined fixed spacing has now been adapted to transfer the springs at different spacings in a very simple and expeditious manner for the making of spring assemblies of different size and/or different spacing of springs within a given size.

It should be understood that the present disclosure is for the purpose of illustration only and includes all modifications or improvements which fall within the scope of appended claims.

I claim:

1. Apparatus for presenting a row of coils with the coils in the row at a predetermined spacing and properly oriented to coil receiving means at a different predetermined spacing in a spring assembly machine comprising a plurality of spaced magazines for receiving groups of coils, coil gripping means situated at the discharge ends of the magazines for gripping the coils at said ends and transferring them to the receiving means of the spring assembly machine, means supporting the gripping means for arcuate movement about a horizontal axis from a position confronting the magazine to a position confronting the assembly machine and for relative movement along the support to change the spacing between the coils from the spacing corresponding to the spacing of the magazines to a spacing corresponding to the spacing of the coil receiving means of the spring assembly machine, said means supporting the gripping means comprising a rotatably oscillatable beam, blocks corresponding in number to the gripping means having at one side planar surfaces to which the grippers are attached and means at the other side for mounting the blocks to the beam for movement longitudinally thereof and relative to each other, spaced parallel lugs at the upper ends of the blocks, means connecting the lugs of adjacent blocks, said means collectively connecting all of the blocks longitudinally of the beam, said means being adjustable to determine the minimum distance between blocks and further adjustable to limit the maximum distance between blocks, a rigid rod connected to the block at one end of the beam, means for rotating the beam to move the blocks arcuately in planes perpendicular to the axis of the beam approximately 180° from a position in which the grippers confront the coils in the magazines to a position in which they confront the receiving means of the spring assembly machine and means for effecting reciprocation of the rod lengthwise of the beam in timed relation to the oscillation of the beam to effect movement of the grippers along the beam from a spacing corresponding to the spacing of the magazines to a spacing corresponding to the spacing of the receivers.

2. Apparatus for presenting a row of coils with the coils in the row at a predetermined spacing and properly oriented to coil receiving means at a different predetermined spacing in a spring assembly machine comprising a plurality of spaced magazines for receiving groups of coils, coil gripping means situated at the discharge ends of the magazines for gripping the coils at said ends and transferring them to the receiving means of the spring assembly machine, means supporting the gripping means for arcuate movement about a horizontal axis from a position confronting the magazines to a position confronting the assembly machine and for relative movement along the support to change the spacing between the coils from the spacing corresponding to the spacing of the magazines to a spacing corresponding to the spacing of the coil receiving means of the spring assembly machine, said means supporting the gripping means comprising a rotatably oscillatable beam containing a longitudinal slot bounded at its top and bottom longitudinal edges by longitudinal ribs, blocks corresponding in number to the gripping means having at one face planar surfaces to which the grippers are attached and at the other face parts perpendicular to said faces containing vertically-spaced, parallel grooves within which are slidably engaged the ribs bounding the slot in the beam, said blocks also having at their upper ends transversely-spaced, parallel lugs containing aligned bolt holes, threaded bolts mounted in the bolt holes of the lugs of adjacent blocks so as to extend from one block to the next, said bolts collectively connecting all of the blocks longitudinally of the beam, each bolt having a head at one end engaged with an inner side of the lug with which it is associated and a nut at the other end engaged with the inner side of the lug with which it is associated, and two nuts between the lugs adapted to be rotated relative to the lugs and to each other to determine the minimum distance between the blocks and the nut at the end being rotatable to move the blocks relative to each other to limit the maximum distance between the blocks, a rigid rod connected to the block at one end of the beam, means for rotating the beam to move the blocks arcuately in planes perpendicular to the axis of the beam approximately 180° from a position in which the grippers confront the coils in the magazines to a position in which they confront the receiving means of the spring assembly machine and means for effecting reciprocation of the rod lengthwise of the beam in timed relation to the oscillation of the beam to effect movement of the grippers along the beam from a spacing corresponding to the spacing of the magazines to a spacing corresponding to the receivers.

* * * * *